US010197265B2

(12) United States Patent
Bien

(10) Patent No.: US 10,197,265 B2
(45) Date of Patent: Feb. 5, 2019

(54) LIGHT DEVICE FOR FLYING DISC TARGET

(71) Applicant: Stephen Willis Bien, Maplewood, MN (US)

(72) Inventor: Stephen Willis Bien, Maplewood, MN (US)

( * ) Notice: Subject to any disclaimer, the term of this patent is extended or adjusted under 35 U.S.C. 154(b) by 513 days.

(21) Appl. No.: 14/727,625

(22) Filed: Jun. 1, 2015

(65) Prior Publication Data

US 2015/0345777 A1 Dec. 3, 2015

Related U.S. Application Data

(60) Provisional application No. 61/997,353, filed on May 30, 2014.

(51) Int. Cl.

| | |
|---|---|
| ***F21L 4/00*** | (2006.01) |
| ***F21V 33/00*** | (2006.01) |
| ***F21L 4/02*** | (2006.01) |
| ***A63B 63/00*** | (2006.01) |
| ***A63B 67/06*** | (2006.01) |

(Continued)

(52) U.S. Cl.

CPC ..... *F21V 33/008* (2013.01); *A63B 63/00* (2013.01); *A63B 67/02* (2013.01); *A63B 67/06* (2013.01); *A63B 71/02* (2013.01); *F21L 4/02* (2013.01); *A63B 2071/026* (2013.01); *A63B 2207/02* (2013.01); *A63B 2209/00* (2013.01); *F21L 4/08* (2013.01); *F21V 15/005* (2013.01); *F21V 23/0464* (2013.01); *F21V 31/005* (2013.01); *F21Y 2103/33* (2016.08); *F21Y 2115/10* (2016.08)

(58) Field of Classification Search

CPC ..... F21Y 2103/33; A63H 33/18; A63H 33/22; A63B 2207/00; A63B 2207/02; A63B 67/06; A63B 67/063; A63B 63/00

See application file for complete search history.

(56) References Cited

U.S. PATENT DOCUMENTS

| | | | |
|---|---|---|---|
| 989,944 | A | 4/1911 | Bramson |
| 3,911,264 | A | 10/1975 | Chao |

(Continued)

OTHER PUBLICATIONS

Black Jax Sports, "TerraPOD Light-Up LOCATOR POD Product Information," www.blackjaxsports.com, Jun. 3, 2008 (2 pages), accessed Jun. 8, 2015.

(Continued)

*Primary Examiner* — Karabi Guharay
*Assistant Examiner* — Meghan Ulanday
(74) *Attorney, Agent, or Firm* — Pauly, DeVries Smith & Deffner LLC

(57) ABSTRACT

A light device for use on a flying disc entrapment device is described including a substantially ring-shaped structure and a first array including a plurality of light sources attached to the substantially ring-shaped structure. The light sources are directed toward a first side of the ring-shaped structure. The light device also includes a battery power source configured to provide power to the first array and a switch configured to control the illumination provided by the first array. In one embodiment, the light device includes a pump circuit electrically connected to the battery power source and the first array, wherein the pump circuit is configured to supply a pulsed current to the first array.

21 Claims, 12 Drawing Sheets

(51) Int. Cl.

| | |
|---|---|
| ***A63B 67/02*** | (2006.01) |
| ***A63B 71/02*** | (2006.01) |
| *F21L 4/08* | (2006.01) |
| *F21V 23/04* | (2006.01) |
| *F21V 31/00* | (2006.01) |
| *F21V 15/00* | (2015.01) |
| *F21Y 103/33* | (2016.01) |
| *F21Y 115/10* | (2016.01) |

(56) References Cited

U.S. PATENT DOCUMENTS

| | | | | |
|---|---|---|---|---|
| 4,006,556 | A | 2/1977 | Williams et al. | |
| 5,358,255 | A * | 10/1994 | Jolson | A63B 67/06 273/400 |
| 6,494,455 | B1 * | 12/2002 | Headrick | A63B 63/00 273/400 |
| 6,554,285 | B2 * | 4/2003 | Chittenden | A63B 67/06 273/400 |
| 7,229,182 | B2 | 6/2007 | Schrader et al. | |
| 7,360,918 | B2 * | 4/2008 | Trombetta | F21S 6/001 362/161 |
| 7,621,536 | B2 * | 11/2009 | Orzech | A63B 63/00 273/400 |
| 8,608,167 | B2 | 12/2013 | Raymond et al. | |
| 8,764,017 | B2 | 7/2014 | Brooks et al. | |
| 2003/0025272 | A1 * | 2/2003 | Billig | A63B 67/06 273/400 |
| 2008/0139343 | A1 * | 6/2008 | Sandman | A63B 63/08 273/400 |
| 2010/0141156 | A1 | 6/2010 | Canino et al. | |
| 2011/0042901 | A1 * | 2/2011 | Raymond | A63B 63/007 273/407 |
| 2013/0229823 | A1 | 9/2013 | Sanford et al. | |
| 2014/0265137 | A1 | 9/2014 | Gradinger et al. | |
| 2015/0061225 | A1 | 3/2015 | Sciandra | |

OTHER PUBLICATIONS dgNomad, "Nite Chains Product Information," www.dgnomad.com, 2015 (5 pages), accessed Jun. 8, 2015.

Disc Golf Association, "Disc Golf Basket Blades Product Information," www.discgolf.com/disc-golf-baskets/basket-blades/, accessed Jun. 8, 2015 (2 pages).

Night Flight Disc Golf, "LED Disc and LED Basket Product Information," www.nightflightdiscgolf.com/index.html, 2012 (4 pages) accessed Jun. 8, 2016.

NightDiscGolf.com, "Disc Golf Basket Markers Product Information," www.nightdiscgolf.com, accessed Jun. 8, 2015 (5 pages).

Nite Ize, Inc., "LED Sports Belt and Slap Wrap Product Information," www.niteize.com, 2015 (3 pages) accessed Jun. 8, 2015.

* cited by examiner

LIGHT DEVICE FOR FLYING DISC TARGET

This application claims priority to U.S. Provisional Application No. 61/997,353, filed May 30, 2014, the contents of which are incorporated by reference in its entirety herein.

FIELD OF THE INVENTION

The present invention is generally related to a device for lighting a portion of a disc entrapment device, and, more particularly, to a ring-shaped device that can be attached or positioned on a disc entrapment device, also referred to as a disc golf basket, for enabling use of the disc entrapment device in low light conditions.

BACKGROUND OF THE INVENTION

In disc golf, a player tosses a disc at a target, and attempts to reach the target with as few throws as possible. Many players enjoy disc golf for the physical activity, the challenge of improving their accuracy, the competition against other players, the opportunity to be outdoors, and for many other reasons.

One example of a disc golf target is a disc entrapment device, also referred to as disc golf baskets, where the goal is for the disc to rest within the a basket structure of the target. Disc Golf Association, Inc. and Innova Champion Discs, Inc. are companies that make a number of different types of disc golf targets. Common elements of disc golf targets include a pole mounted in the ground or attached to a base and a top-opening, circular basket mounted on the pole. Other common elements are a ring cap assembly mounted near the top of the pole and above the top-opening basket, where the ring cap assembly supports multiple chains hanging down from the ring cap assembly and secured to the pole. The chains are designed to absorb the energy of the flying disc and facilitate the disc dropping into the circular basket, which is mounted below the chains. Some disc golf targets include an inverted cone structure instead of chains.

U.S. Pat. No. 6,494,455, titled FLYING DISC ENTRAPMENT DEVICE, describes a light integrated into a top portion of a flying disc entrapment device.

BRIEF SUMMARY

A light device for use on a flying disc entrapment device is described including a substantially ring-shaped structure and a first array including a plurality of light sources attached to the substantially ring-shaped structure. The light sources are directed toward a first side of the ring-shaped structure. The light device also includes a battery power source configured to provide power to the first array and a switch configured to control the illumination provided by the first array. In one embodiment, the light device includes a pump circuit electrically connected to the battery power source and the first array, wherein the pump circuit is configured to supply a pulsed current to the first array.

In one embodiment, the light sources are spaced apart and oriented about the substantially ring-shaped structure such that, when the device is disposed on a portion of flying disc entrapment device, the light sources illuminate substantially all of a circumference of an illuminated portion of the device.

A system is described herein for illuminating a flying disc entrapment device including a flying disc entrapment device and a light device. The flying disc entrapment device includes an open top basket mounted on an upright pole and an absorption structure attached to the upright pole above the open top basket. The light device is sized and configured to be selectively placed upon and removed from a first portion of the entrapment device in order to illuminate a second portion of the entrapment device.

In one embodiment, the substantially ring-shaped structure includes a second side, wherein the second side is substantially opaque and the first side is translucent. In one embodiment, the second side further comprises a reflective material configured to direct light to the first side.

In one embodiment, the light device further includes a locking loop configured for receiving a locking device.

In one embodiment, the light device further includes a carrying structure to facilitate attaching the light device to another structure, the carrying structure comprising a flexible member loop secured around the substantially ring-shaped structure.

In one embodiment, the first side defines a plurality of evenly spaced grooves, wherein each groove extends in a radial direction.

In one embodiment, the substantially ring-shaped structure defines a cavity, and wherein the plurality of light sources is housed within the cavity.

In one embodiment, the cavity is separated from the environment by a water-resistant seal.

In one embodiment, the light device includes a tube defining the cavity and having two ends and a coupler configured to connect the two ends of the tube to form a ring. In one embodiment, the coupler is configured to receive the two ends of the tube, wherein the coupler is further configured to enclose the battery power source and pump circuit.

In one embodiment, the substantially ring-shaped structure comprises a plurality of interlocking sections of material, wherein the first array is attached to an exterior surface of the material on the first side of the light device, wherein the light device further comprises a photovoltaic cell attached to an exterior surface of the material on a second side of the light device opposite from the first side, wherein the photovoltaic cell is configured to supply power to the battery power source.

In one embodiment, the plurality of light sources comprises ten or more light sources.

In one embodiment, the light device further includes a light sensor configured to control power to the light sources based on whether the ambient environment is substantially dark.

In one embodiment, the light device further includes a solar cell configured to supply charge to the battery.

In one embodiment, the light device is configured so that the battery power source is accessible and replaceable.

In one embodiment, a first portion of the entrapment device for receiving the light device is on a ring cap assembly mounted on the upright pole above an absorption structure and a second portion of the entrapment device for illumination is the absorption structure, wherein the absorption structure comprises a plurality of chains suspended from the ring cap assembly.

In one embodiment, the light device further includes a tube defining the cavity and having two ends and a coupler configured to connect the two ends of the tube to form a ring, wherein the plurality of light sources is housed within the cavity.

In one embodiment, the substantially ring-shaped structure comprises a plurality of interlocking sections of material, wherein the first array is attached to an exterior surface of the material on the first side of the light device, wherein the light device further comprises a solar cell attached to an exterior surface of the material on a second side of the light device opposite from the first side, wherein the solar cell is configured to supply power to recharge the battery power source.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense.

BRIEF DESCRIPTION OF THE DRAWINGS

Examples may be more completely understood in connection with the following drawings.

Figure 1:
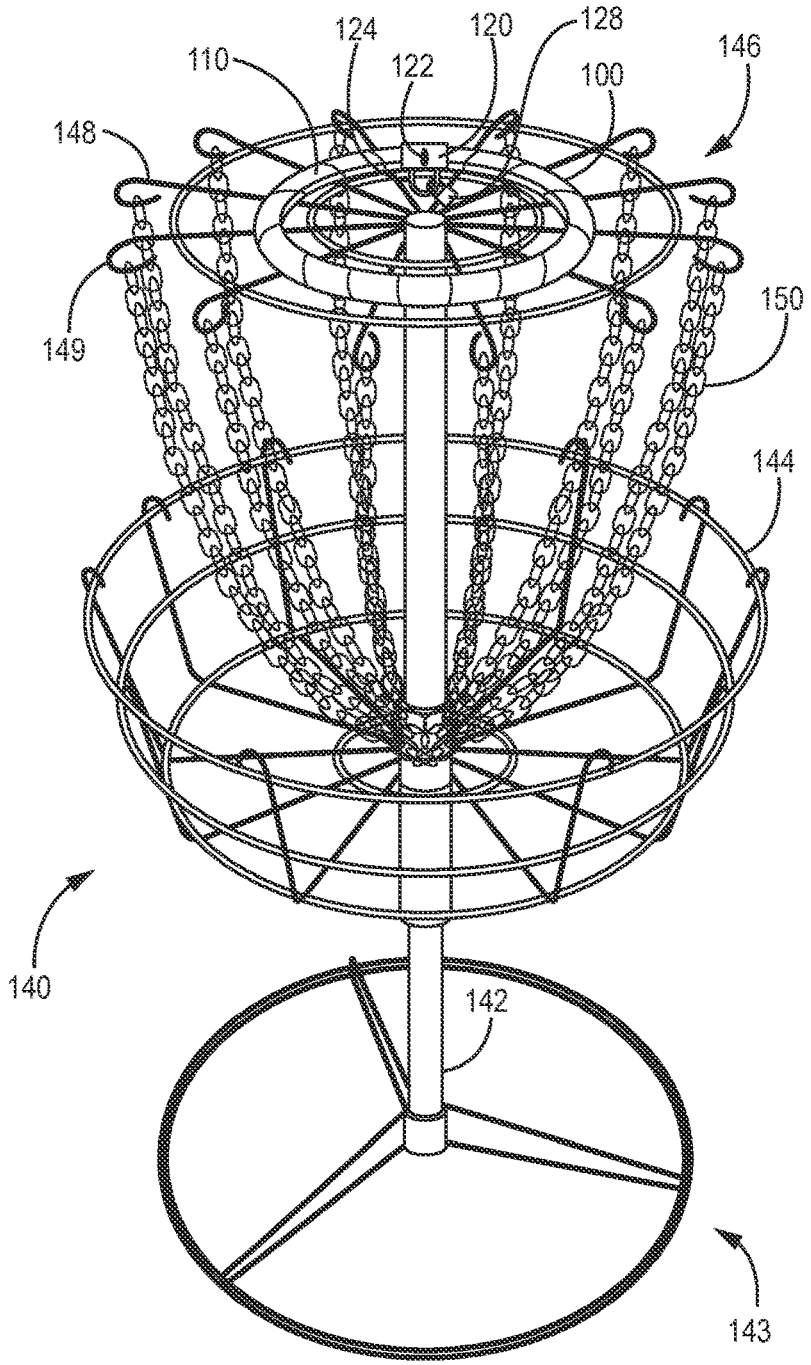
FIG. 1 is perspective view of a flying disc entrapment device and a first example of a light device positioned on the flying disc entrapment device.

While embodiments herein susceptible to various modifications and alternative forms, specifics thereof have been shown by way of example and drawings, and will be described in detail. It should be understood, however, that the scope herein is not limited to the particular examples described. On the contrary, the intention is to cover modifications, equivalents, and alternatives falling within the spirit and scope herein.

DETAILED DESCRIPTION OF THE INVENTION

A light device is described herein that can be used to extend the available time for playing disc golf into low light conditions. In one example, the light device can be positioned on a portion of a flying disc entrapment device that includes an open top basket mounted on an upright pole, a ring cap assembly also mounted to the upright pole, and a energy-absorption structure, such as a plurality of chains hanging from the ring cap assembly. The term "chains" means flexible elements that can move in response to being struck. In other examples, the disc entrapment device used with the light device does not include chains. Another example of an energy absorption structure is a cone-shaped element where the point of the cone is close to the circular basket and the cone is mounted to the upright pole so that it is positioned above the circular basket. The energy absorption structure can also be referred to as a motion arresting structure.

The light device includes a substantially ring-shaped structure. The term "substantially" as applied to ring-shaped means forming at least 270 degrees of a ring-shape or more, and includes a continuous ring structure or a ring structure with a break in the ring.

The light device also includes a first array of a plurality of light sources attached to the substantially ring-shaped structure. The first array is configured so that the light sources are directed toward a first side of the ring-shaped structure. As a result, the light device can be placed on the ring cap assembly of the disc entrapment device with the first side facing down, so that the light sources are directed toward and illuminate the absorption structure and basket. Alternatively, the light device can be placed within the top opening basket with the first side facing up, so that the light sources are directed toward and illuminate the absorption structure. Alternatively, the light device can be placed under the basket with the first side facing up, secured so that the light sources are directed toward and illuminate the absorption structure and basket above.

A number of different examples of light devices, disc golf targets and combinations thereof are described herein. Features of each example can be used in combination with other features described herein, even if those combinations of features are not shown in a particular figure or are specifically described as being used in combination.

Illumination of the absorption structure of a disc golf target device assists the player by focusing his or her attention on the location where striking the device is most desirable. Devices that illuminate only the top of the target or only a portion of the pole of the target do not facilitate the process of aiming at the device in the same way.

The device shown in FIG. 1 is a light device 100 comprising a substantially ring-shaped structure 110, a coupler 120, a loop 124, and a water-resistant seal. Light device 100 is positioned on flying disc entrapment device 140, and secured thereon by locking device 128. Flying disc entrapment device 140 comprises an upright pole 142, an open top basket 144, a ring cap assembly 146, spokes, or ring support structures 148, chain hooks 149, and chains 150. The upright pole 142 is attached to a base structure 143. In an alternative arrangement, the upright pole 142 is mounted in the ground, such as in a cement footing.

The light device is positioned on ring cap assembly 146 such that illumination provided by the device is directed downward. It is preferable for a high amount of the illumination to be provided to the chains, so that they are visible to disc golf players from a distance that is typical in the game. For example, the illuminated target can be visible from distances of about 200 to 450 feet in one example. The illuminated target can be visible from shorter distances, such as the distance of the typical approach shot, such as 30-100 feet, in one example.

Figure 2:
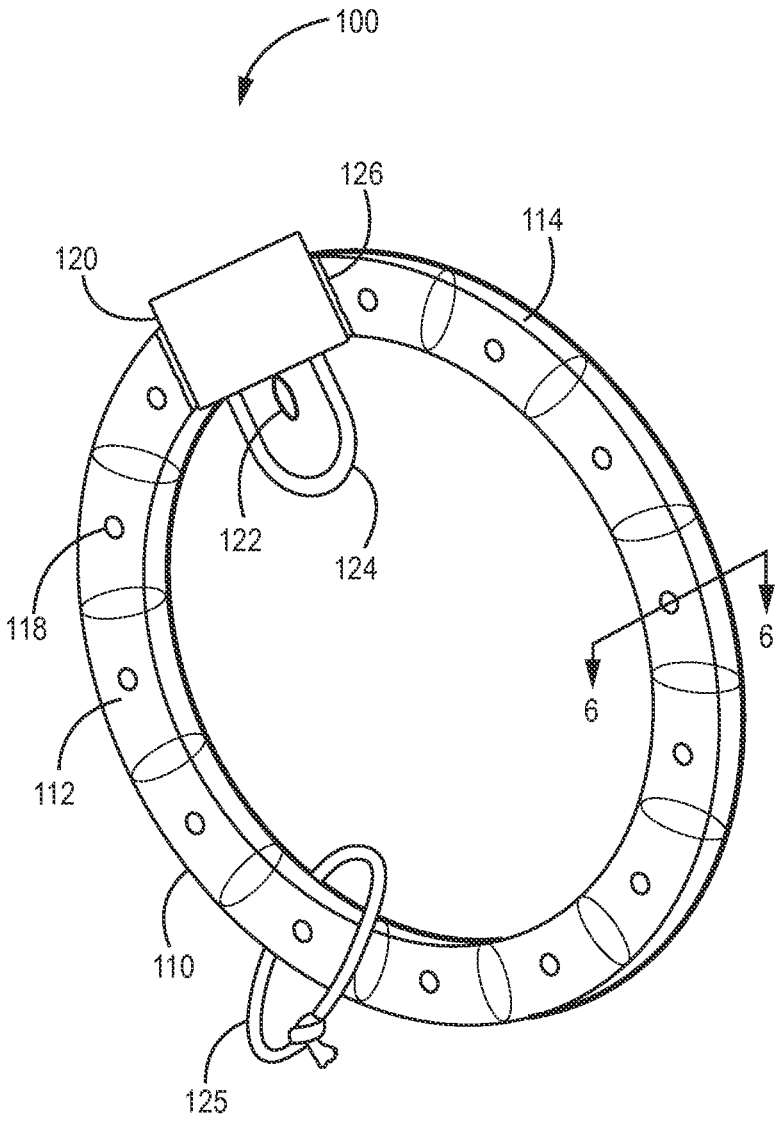
FIG. 2 is perspective view of the light device of FIG. 1.

FIG. 2 shows an enlarged, bottom perspective view of the light device 100 of FIG. 1. In this particular embodiment, ring structure 110 (referred to as "ring" hereinafter) comprises a translucent first side 112, and an opaque second side 114. The first side 112 is configured to face down when light device 100 is placed on a flying disc entrapment device so that illumination will be provided to the basket. In one method of using the device, the second side 114 is configured to face up when light device 100 is placed on a top surface of a flying disc entrapment device so that upward illumination is minimized.

In this example, first side 112 and second side 114 comprise the same translucent material, with the second side 114 further comprising an opaque film disposed thereon or therein such that the second side 114 is opaque. In other examples, first side 112 and second side 114 may comprise different materials. Ring 110 may comprise any translucent material. In one example, the ring is made of a polymeric material. In one example, the ring comprises polyvinyl chloride (PVC). The particular embodiment illustrated in FIGS. 1-6 comprises a flexible PVC tube.

Illumination is provided by an array comprising a plurality of light sources 118 attached to ring 110. Light sources may comprise one of light emitting diodes (LEDs), incandescent light bulbs, gas-discharge lamps, arc lamps, lasers, sulfur lamps, or any other electric lights. In this example, the light device also comprises a battery, not shown in FIG. 2. The battery is configured to provide electric power to the array of light sources. The light device further comprises a circuit board, not shown in FIG. 2. The circuit board is configured to provide a pulsed current to the array of light sources.

Ends of the ring 110 are coupled into a complete ring by coupler 120. In this particular embodiment, coupler 120 is attached to the ends of a flexible PVC tube such that ring 110 is formed. In one example, coupler 120 comprises a polymeric material. In another example, coupler 120 comprises polyvinyl chloride. However, the selection of material for coupler 120 is not limited to polymeric materials, as any material found suitable by one skilled in the art may be used. In the particular example illustrated in FIGS. 1-6, coupler 120 comprises a PVC pipe connector, as is used in the plumbing arts. In this example, coupler 120 and ring 110 define a cavity, not shown in FIG. 2, which houses components of the electrical system.

In this particular example, the connection between coupler 120 and ring 110 is formed using a hot melt polymeric adhesive bond such that a water-resistant seal 126 is formed. However, other forms of bonding may be used to join the components, such as welding or alternative adhesives. A person of ordinary skill in the art would know that there are a number of ways to bond two materials such that a water-resistant bond is formed. Alternate structures for a coupler provide a water-resistance cavity using mechanical structures, without the need for an adhesive. In one example, the coupler is configured so that the cavity can be repeatedly accessed and closed, allowing the battery to be removed and replaced, and so that a water-resistant seal is established between the cavity and the external environment. In various examples, this is possible without the use of adhesives, without the use of tools, or both.

Coupler 120 houses switch 122, which is configured to control the illumination provided by the light device. The switch has the functionality to turn the illumination on or off. In some embodiments, the switch turns the illumination from "off" to an automatic mode, where the lights are controlled by a photovoltaic cell or solar cell so that they turn on only when the external environment is sufficiently dark. In some embodiments, the switch turns the illumination from "on" to the automatic mode, where the lights are controlled by a photovoltaic cell so that they turn off only when the external environment is sufficiently dark. This type of configuration would be well-suited for a permanent installation that would turn off and on in an automated manner, according to the ambient lighting conditions. In various examples, the device includes a clock and a timer circuit so that the lights are turned off at a certain time of the day. In various examples, the device includes a dimmer so that the intensity of the light output by the light sources can be modified, either with user input or based on sensor input.

A loop 124 protrudes from coupler 120. Loop 124 is configured for use with a locking device. In this embodiment, a locking device may be used to couple the loop 124 to one of the plurality of ring support structures 148 of entrapment device 140. This enables the operator of the light device to secure it to a flying disc entrapment device in a way that inhibits theft. In a typical use scenario, a disc golf player might position light devices on each basket at a course before playing the game. Therefore, there will be extended periods of time in which the player is not near a given device. It is therefore advantageous to provide loop 124, so that the operator of the light device can play an enjoyable round of disc golf without the fear that his or her light devices will be stolen. In another typical use scenario, the operator of a disc golf course will own a set of permanently installed light devices for the benefit of their customers. In such permanent installations, it is particularly desirable to have a lockable loop. Loop 124 of the current example comprises a metal cable, such as a steel cable, but loop 124 of other examples may comprise any other material that is configurable for use with a locking device, and has sufficient strength to create an effective security means. In the example of FIG. 2, the metal cable is attached to the coupler by drilling two holes in the coupler, inserting adhesive into the holes and inserting the two ends of the wire cable into the holes. Many other constructions and methods of assembly are possible. In one embodiment, the loop 124 extends from the coupler downwardly at an angle, so that a plane defined by the loop is neither horizontal nor vertical, and creates an angle of less then 90 degrees with a tangent line from the first side 112 of the ring structure 110.

In some embodiments, the ring structure 110 also includes a carrying structure, such as the example of a rope loop 125 shown in FIG. 2. The carrying loop 125 is configured to be used to secure the light device to something that the user is carrying, such as a user's disc golf bag, so that the light device can be easily carried between holes without being misplaced. In one embodiment, the carrying loop 125 is made of a nylon rope.

Figure 3:
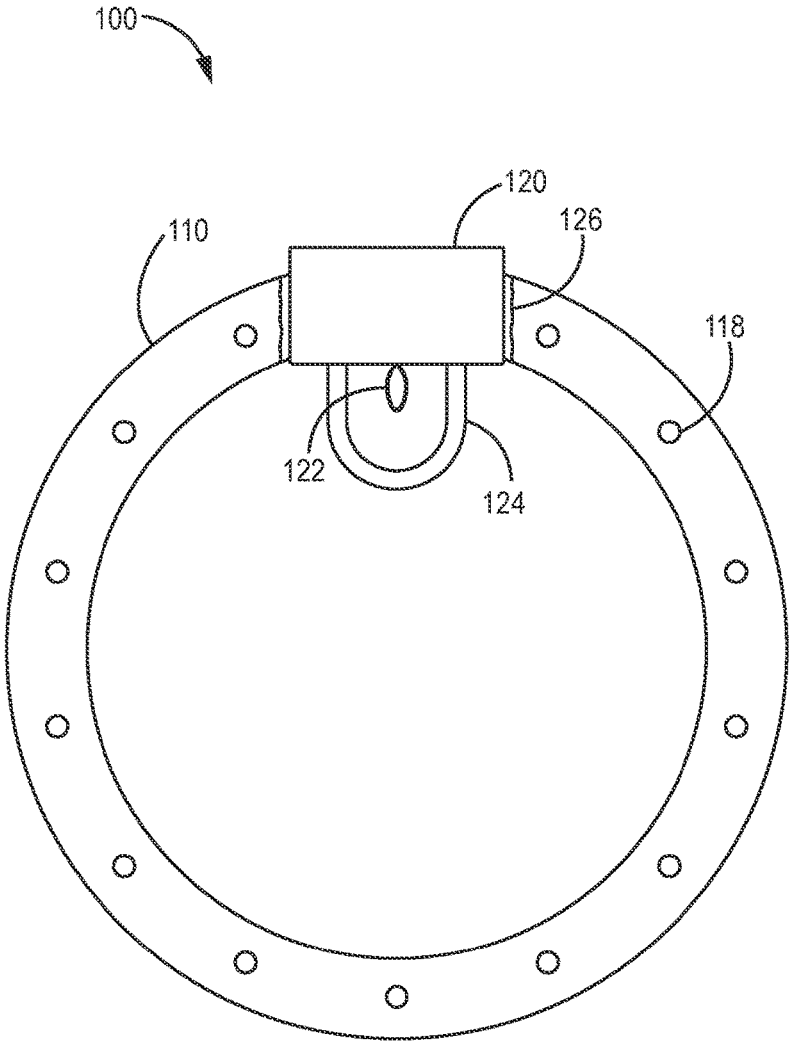
FIG. 3 is a bottom view of the light device of FIG. 1.

FIG. 3 shows a bottom view of light device 100 of FIG. 1. A plurality of light sources 118 forms an array. Light sources 118 are arranged around the ring in a substantially circular and evenly spaced pattern. In one method of using the device, they are directed downwards so as to illuminate a flying disc entrapment device when it is disposed thereon. A water resistant seal 126 is present between the ring structure 110 and the coupler 120.

Figure 4:
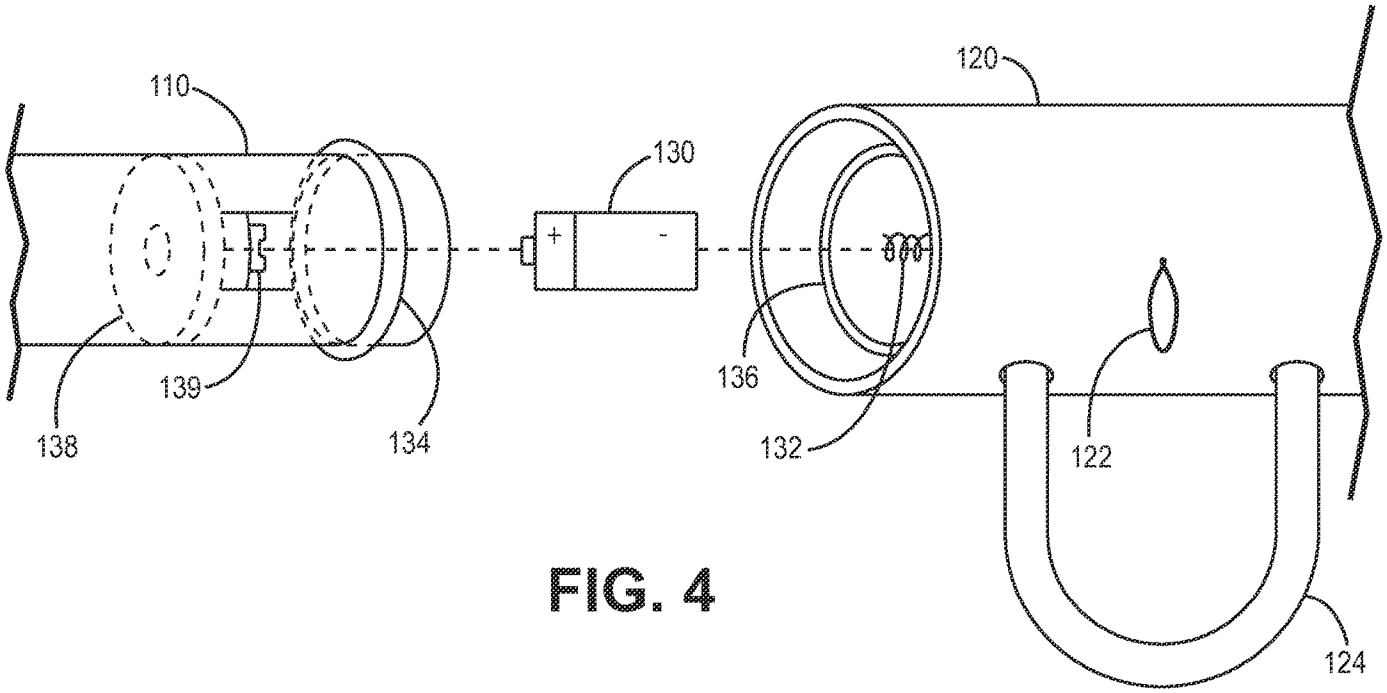
FIG. 4 is a perspective view of a coupler of the light device of FIG. 1, in an disconnected state.

FIG. 4 depicts the light device 100 with the coupler 120 disconnected from the ring structure 110, as might occur in the process of a battery change on the light device of FIG. 1. A battery 130 is housed in coupler 120, and is accessible and replaceable. The term "accessible" means that a user can open the coupler 120 to access its cavity, so that the battery can be reached, without damaging the coupler 120 or the ring structure 110. The term "replaceable" means that a user can remove the battery and replace it with a different battery. Battery connection contact 132 is positioned in the coupler and battery contact 139 is positioned in the mating end of ring 110. Compression provided by the fit between coupler 120 and ring 110 is sufficient to hold battery 130 against the connection contacts 132, 139 during normal operation. Battery 130 is removed by pulling ring 110 out of coupler 120, thereby breaking the water-resistant hot melt adhesive seal. An O-ring 134 is positioned around ring 110, and is configured to be seated in groove 136. O-ring 134 is used to augment the hot melt water-resistant seal.

Figure 5:
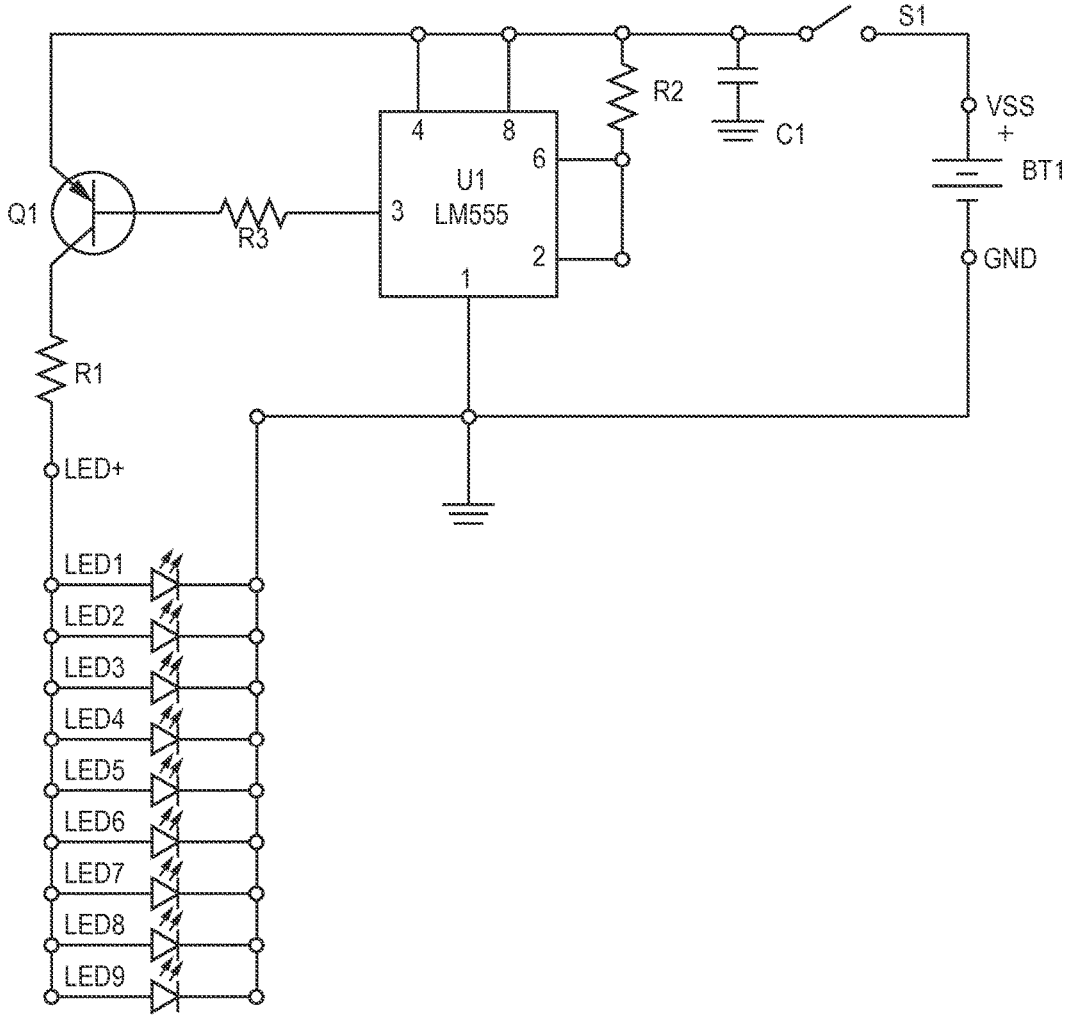
FIG. 5 is a schematic of a circuit board of one example of a light device.

FIG. 5 is an electrical schematic of the circuit of the light device of FIG. 1. FIG. 5 is a circuit diagram of the device of FIG. 1. The circuit is configured to supply a pulsed current to light sources 118. Supply voltage Vss is the voltage across a battery power source BT1. The circuit includes a timer circuit U1 LM555, referred to herein as "timer U1." When switch S1 is closed, Vss is provided to capacitor C1, resistor R2, pins 4 (reset) and 8 (Vcc) of timer U1, and the collector of transistor Q1. The time constant of charging C1, based on the capacitance of C1 and the resistance of R2, dictates the duty cycle of the substantially square pulses provided to light sources 118. The duty cycle may be tuned to achieve a desired light intensity and battery life by choosing proper values of R2 and C1. As C1 is periodically charged and discharged, output pin 3 of U1 provides a signal at the same frequency. This signal is passed through R3 in order to minimize its current, and on to the base of Q1. Q1 amplifies this signal, and its emitter supplies a current that is sufficient to power light sources 118. R1 acts as a voltage divider so that the proper voltage is supplied to the light sources. In this example, the light sources comprise light emitting diodes LEDs 1-9. In one example, the duty cycle causes the lights to be off during intervals shorter than a typical human eye can perceive.

Figure 6:
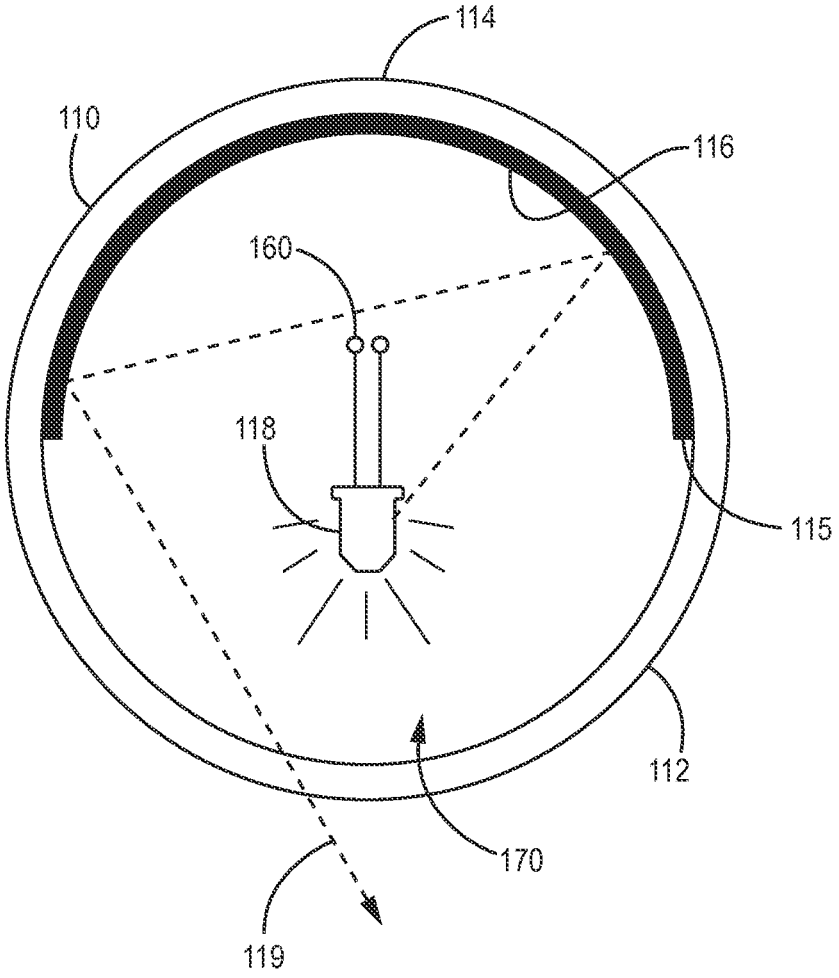
FIG. 6 is a cross-sectional view of the light device of FIG. 1, taken along line 6-6 of FIG. 2.

FIG. 6 is a cross sectional view of the light device of FIG. 2. The cross section of ring 110 is substantially circular, but one of ordinary skill in the art would realize that a number of cross sectional shapes are possible that would enable the inventive concept. The translucent first side 112 and opaque second side 114 are shown to define a cavity 170. A liner 115 can be opaque in order to provide the opaque quality to the opaque second side 114. The liner 115 can also have a reflective surface 116 in order to direct light toward the translucent first side 112. In an alternate embodiment, not shown, the first side 112 is selectively translucent in the vicinity of the light sources.

Light source 118 is positioned in cavity 170 such that it is directed towards the first side 112. The phrase "directed toward a first side" means that the light source is unobstructed by opaque components, such as electrical conductors or other opaque structural elements, when viewed from the first side 112. Source 118 is electrically connected to and suspended from electrical conductors 160. Light from source 118 that is directed towards the second side 114 will be reflected by surface 116 and redirected toward the first side 112, as seen by ray trace 119. This is advantageous as it maximizes the amount of light directed towards a disc golf basket on which the device is placed, thereby achieving a higher amount of illumination given a constant amount radiating from the sources 118.

Figure 7:
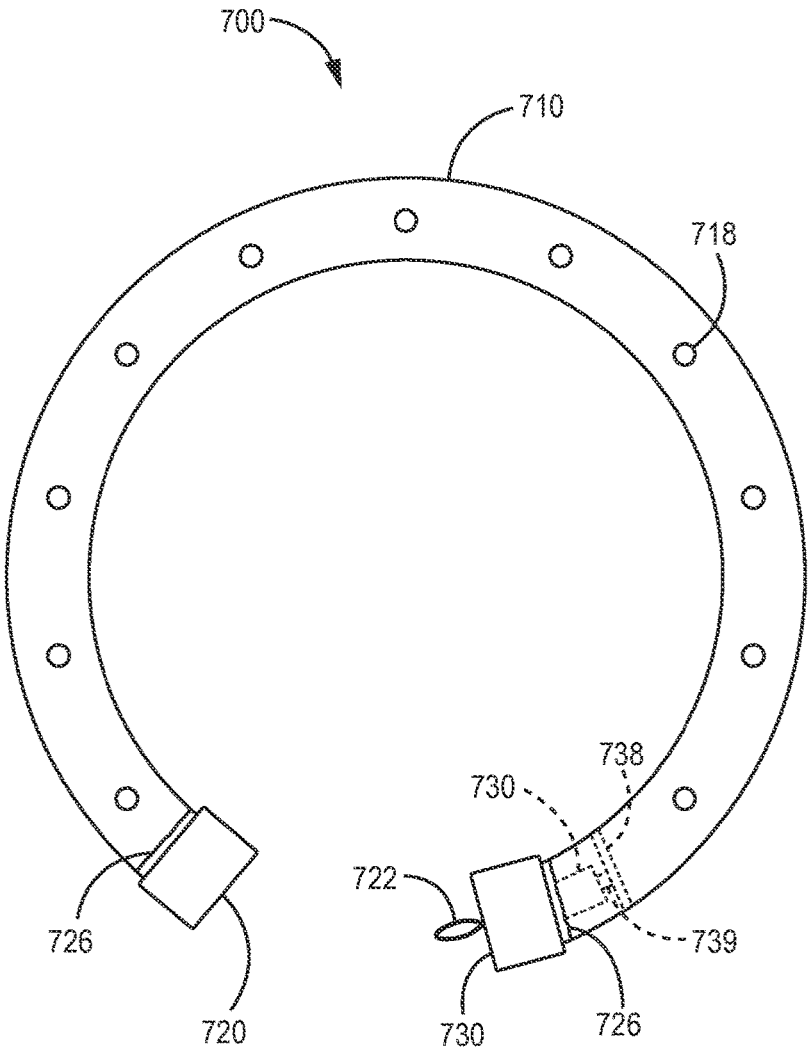
FIG. 7 is a bottom view of one example of a light device having a split ring structure.

FIG. 7 depicts an alternative embodiment of the light device of FIG. 1. Light device 700 comprises a substantially ring shaped structure 710 (referred to hereinafter as "open ring"), an array comprising a plurality of light sources 718, a first end cap 720, a second end cap 730, and a water-tight seal 726. Light device 700 forms an open, or split ring that enables it to be used on alternative flying disc entrapment devices, such as those that replace a ring assembly and plurality of chains with an inverted cone configured to direct incoming flying discs downward into an open basket. On such entrapment devices, the cones are typically constructed with an opaque polymeric material, so a light device placed on top of the cone would not adequately illuminate the target. By providing a light device 700 that forms an open ring, it can be positioned around an upright pole of an entrapment device and can rest in the circular basket or be attached below the circular basket, such that illumination is provided from below and on to the cone.

One of the end caps, such as second end cap 730, houses electronic components used to provide power to light sources 718. A switch 722 can be supported by the second end cap 730 and can emerge from an opening in the second end cap 730. A water-tight seal 726 can be provided at each juncture between an end cap 720, 730 and the open ring 710.

Light sources 718 are positioned around the open ring structure 710, and are configured to direct light upwards when light device 700 is placed around an upright pole of a flying disc entrapment device. Light sources are positioned to be approximately evenly spaced around the open ring 710.

Figure 8:
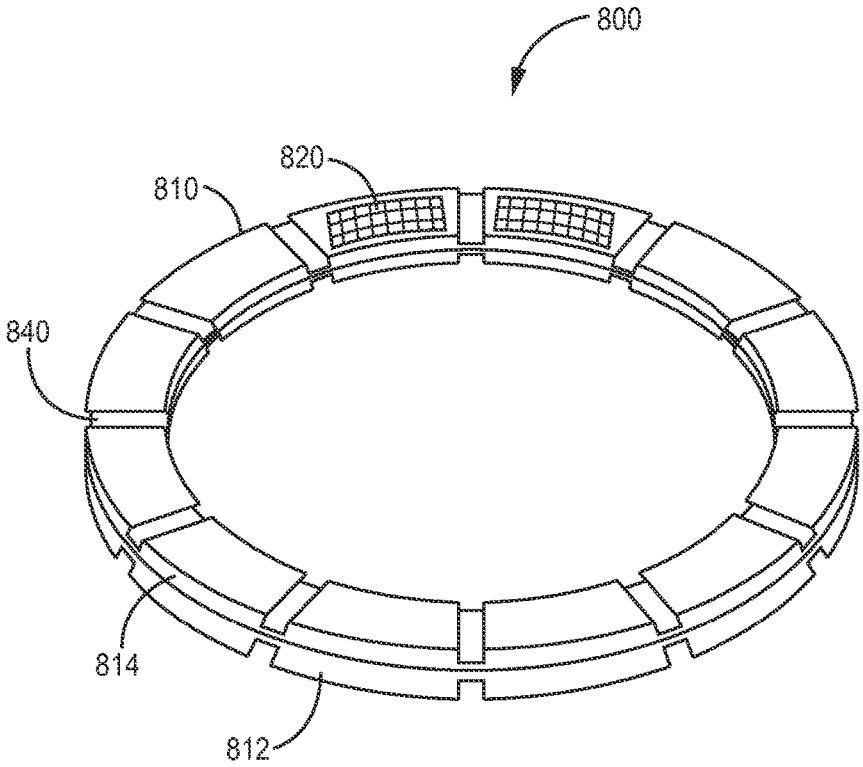
FIG. 8 is a perspective view of a further example of a light device.

FIG. 8 is a top perspective view of a light device 800 comprising a ring-shaped structure 810 comprising a translucent first side 812, an opaque second side 814, and photovoltaic or solar cells 820. Channels or grooves 840 are formed at least on the first side 812, and are configured to mate with the ring support structures, or spokes, of a flying disc entrapment device. The channels 840 extend in a radial direction across the surface of the ring structure 810. In the embodiment of FIG. 8, channels 840 are formed on the second side 814 also. The channels 840 have a width of at least about The photovoltaic cells 820 are configured to provide charge to a battery power source during light conditions. The amount of charge supplied to the battery power source during light conditions is sufficient for the battery to provide power to an array of light sources during nighttime disc golf play. This enables the battery of a light device 800 to be usable for extended periods of time without replacement. This is particularly advantageous for use on permanently installed units that are frequently used.

The first side 812 and second side 814 of the ring 800 connect to define a cavity there between. In one embodiment, the photovoltaic cells 820 are positioned within the cavity, and are provided with a transparent portion or cut-out portion to allow more sunlight to reach them. In another embodiment, the photo voltaic cells are positioned on an exterior surface of the second side 814. The cavity defined within the first and second sides 812, 814 can contain other components of the light ring, as discussed with respect to other embodiments described herein. In one embodiment, the first and second sides 812, 814 are substantially identical, such that they can be generated from the same mold. In one embodiment, each of the first and second sides 812, 814 is made up of a plurality of pieces, such as three pieces, that can form joints with the other pieces to form the ring structure 810.

Figure 9:
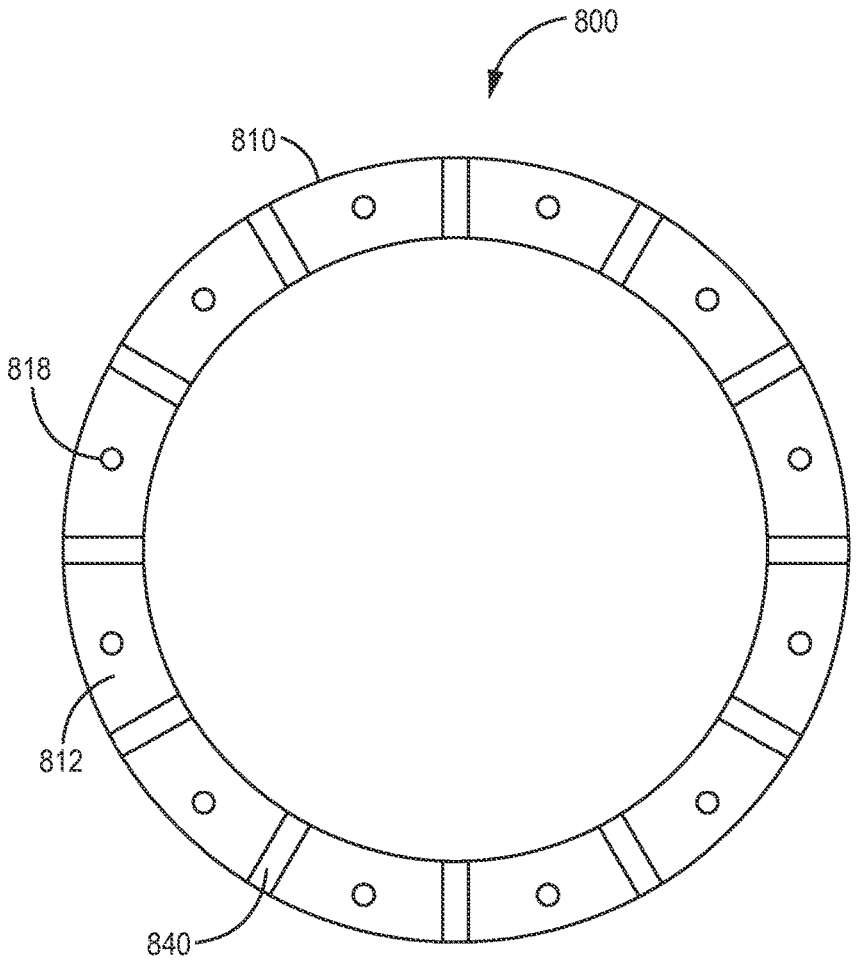
FIG. 9 is a bottom view of the light device of FIG. 8.

FIG. 9 shows a bottom plan view of the first side 812 of the light device 800 of FIG. 8. An array comprising a plurality of light sources 818 is disposed within a cavity defined by the first and second sides. Light sources 818 are positioned such that their light is directed toward first side 812. Light sources 818 are arranged about channels 840 in such a way that prevents illumination from the sources 818 from being blocked by the spokes of an entrapment device when the channels 840 are seated on said spokes. For example, the light sources 818 are positioned to be offset and not overlapping with the positions of the channels 840. The light sources 818 are within a cavity of the ring 810, and the positions of light sources 818 are indicated on FIG. 8. However, other features within the ring structure 810 are not shown in FIG. 8, such as a conductor, battery or circuit board. These components can be positioned within the ring structure 810.

Figure 10:
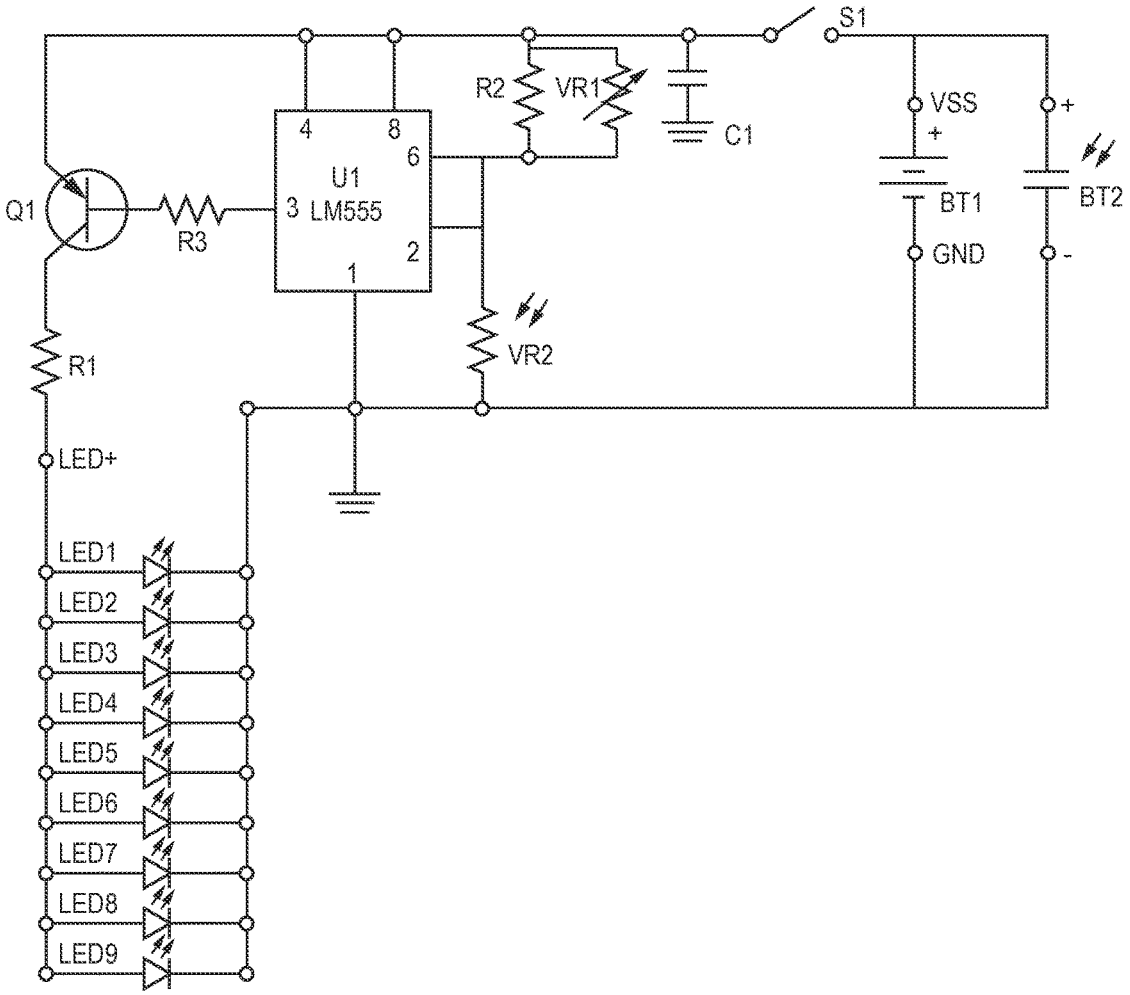
FIG. 10 is a schematic diagram of a circuit board according to another example of a light device.

FIG. 10 shows a schematic of the electric circuit used to power the light sources. FIG. 10 is a circuit diagram of the device of FIGS. 11 and 12, for example. The operating principle is substantially the same as the circuit of FIG. 5, but with added functionality. A photovoltaic solar cell BT2 is connected in parallel with battery power source BT1, and is configured to charge BT1. There may be some recharging circuitry associated with BT1, which is not illustrated and is known to those of skill in the art. Photoresistor VR2 is used to vary the voltage at pins 6 (threshold) and 2 (trigger) of a timer circuit U1 LM555, referred to herein as "timer U1." When the amount of light incident on VR2 decreases beyond a threshold value the voltages at pins 6 and 2 of timer U1 cross a corresponding threshold which triggers the lights to turn on. When S1 is closed, this automatic light engagement will occur when the environment becomes substantially dark. When S1 is open, the lights will not be turned on in any light condition. In one example, S1 is replaced with a jumper, thereby fully automating on-off control of the lights. There are many different configurations possible for the electrical circuit of a light device as described herein.

Figure 11:
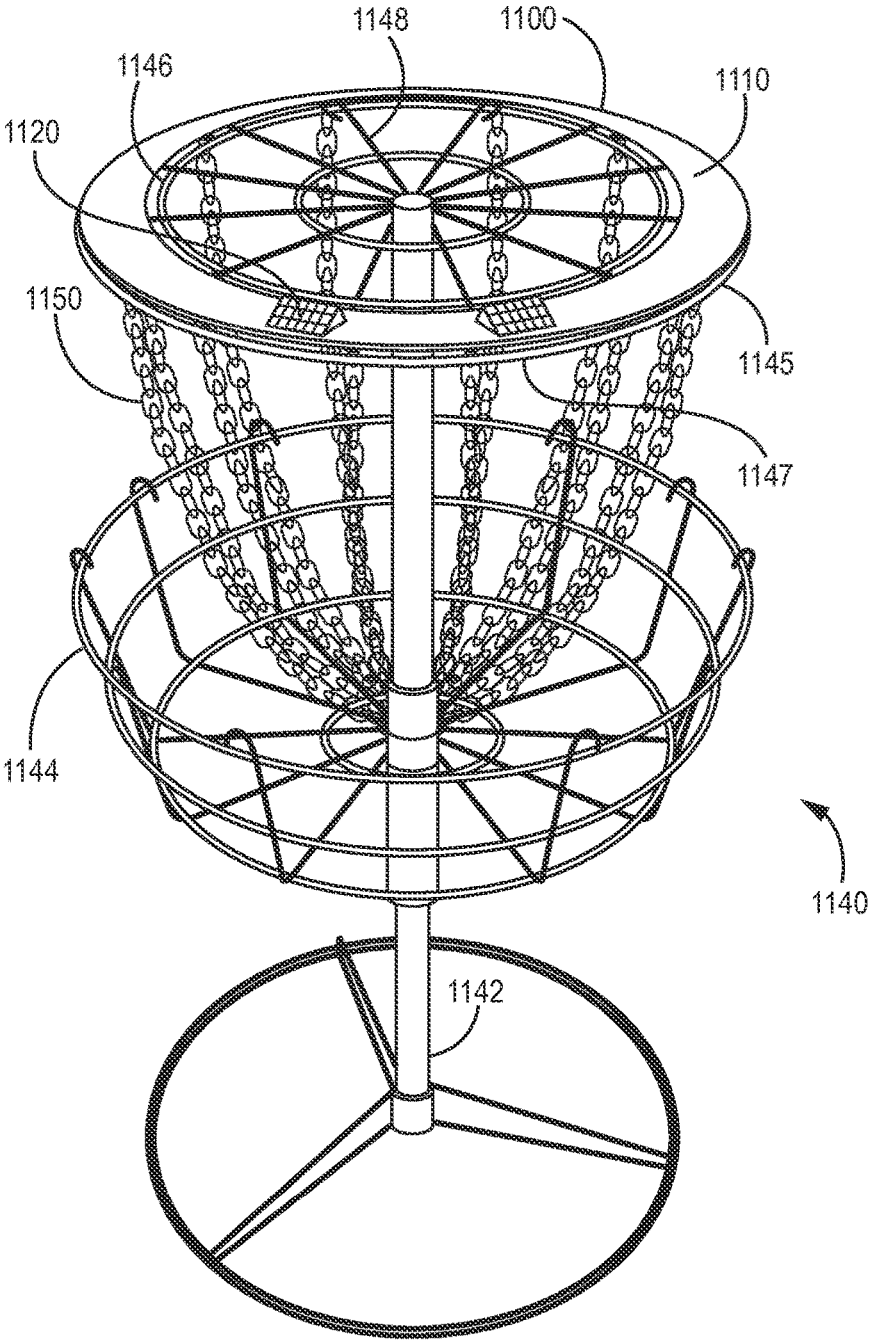
FIG. 11 is a perspective view of a flying disc entrapment device and a further example of a light device positioned on the flying disc entrapment device.

FIG. 11 shows a light device 1100 comprising a substantially ring-shaped structure 1110, and one or more photovoltaic cells 1120. Light device 1100 is positioned on flying disc entrapment device 1140. Flying disc entrapment device 1140 comprises an upright pole 1142, an open top basket 1144, a ring cap assembly 1145 comprising upper ring 1146 and lower ring 1147, spokes, or ring support structures 1148, and chains 1150. Upper ring 1146 is located above and has a smaller diameter than lower ring 1147. The upper and lower rings 1146, 1147 of entrapment device 1140 are concentric.

Ring structure 1110 comprises a semi-conical surface on which other components, such as photovoltaic cells 1120, are mounted. The ring structure 1110 is compatible for use on certain flying disc entrapment devices, such as the Mach II and Mach V models available from Disc Golf Association Inc. of Watsonville, Ca. In one method of using the device, it is placed on top of ring cap assembly 1145, between upper ring 1146 and lower ring 1147, such that illumination provided by the device is directed downwards towards chains 1150. Photovoltaic cells 1120 are positioned on ring 1110 such that they face upwards when device 1100 is so used on entrapment device 1140.

Figure 12:
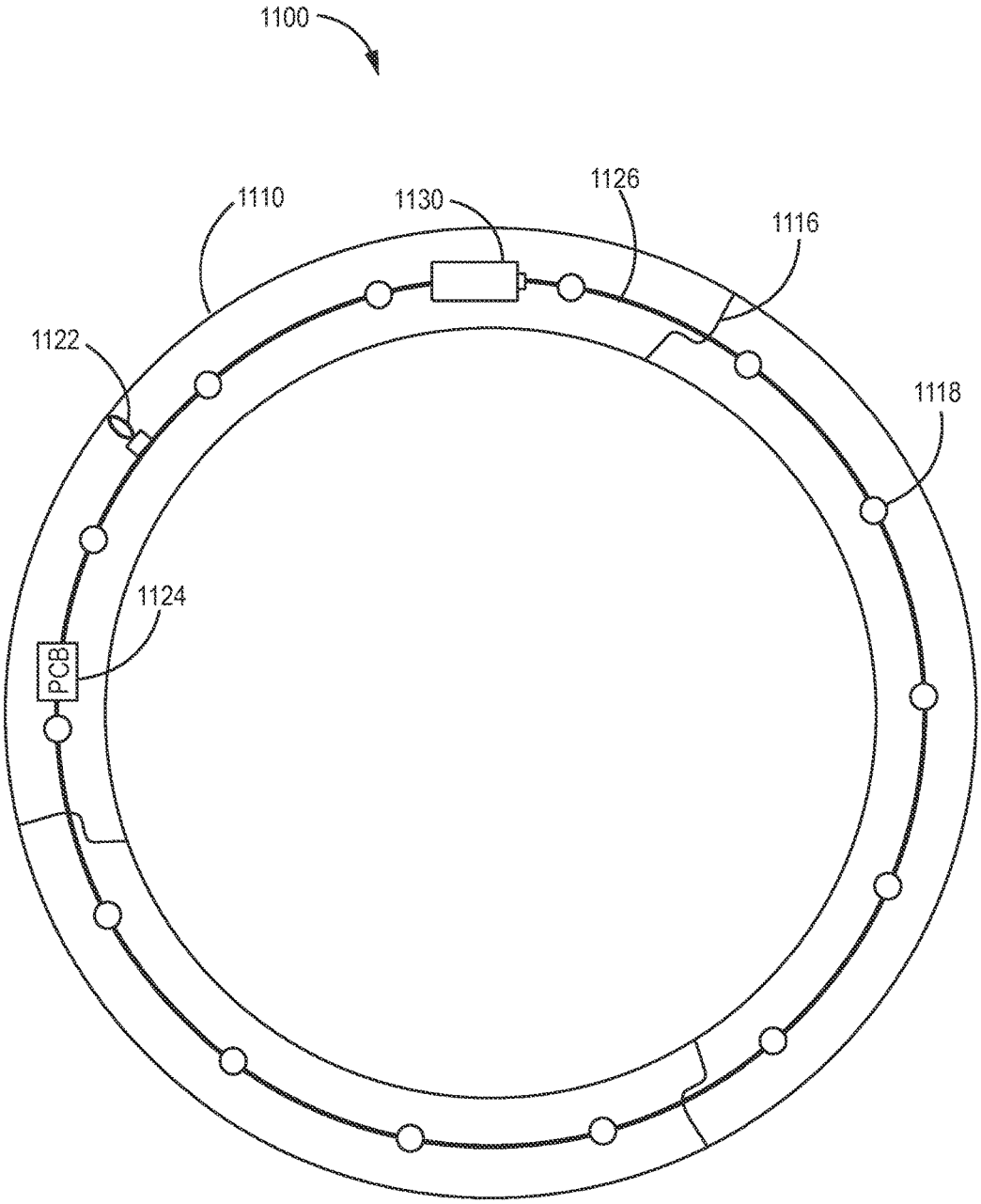
FIG. 12 is a bottom view of the light device of FIG. 11.

FIG. 12 shows a bottom plan view of a first side 1112 of light device 1100. Disposed on first side 1112 of ring 1110 is an array comprising a plurality of light sources 1118, switch 1122, circuit board 1124, a plurality of electrically conductive surfaces 1126 configured to be electrically connected to light sources 1118, and battery 1130. In this example, ring 1116 comprises a plurality of components configured to be joined at junctions 1116 to form a solid assembly. In other examples, ring 1110 comprises a single piece of material. In the example of FIGS. 11 & 12, components of the device are mounted on the external surface of ring 1110. As such, electrical components are exposed to the ambient environment. In some examples, circuit board 1124 and other electronic components are coated in a waterproof sealant which shields components from moisture. Suitable sealants for this purpose include HumiSeal, available from Chase Corporation of Bridgewater, Mass.; Dome Magic 1830 Rain Fade Solution, available from King Controls of Minneapolis, Minn.; or any other waterproof coatings used in the electronic arts.

One example of a light device with the general form of the device of FIGS. 11 & 12 comprises a three-component ring. These particular three components are available as a Disc Golf Basket Blade kit from the Disc Golf Association of Watsonville, Calif. These "Blades" are vinyl bodies that are configured for permanent installation on the aforementioned Mach II and Mach V disc golf baskets. The blades are positioned around the circumference of the ring assembly of an entrapment device, and are typically used to display the target number, course name, advertisements, or other information. In this example, the electrical components of light device are mounted to the blades, so the blades perform the above mentioned functions as well as provide the ring structure of the light device. The three components of the ring are fastened to each other at overlapping joints 1116. Attachment structures such as screws may be used to attach the ends of each component to another component. In one embodiment, a portion of one or more components can pass under a portion of the ring cap assembly 1145 of the disc golf target 1140, so that the ring structure 1110 is secured to the disc golf target 1140 and cannot be easily removed from the disc golf target 1140 without the use of tools or damaging the blades.

Other examples of light devices with features beyond those illustrated in the figures may exist that achieve the same end of facilitating the nighttime playing of disc golf. Any of the embodiments of FIGS. 1-12 may further comprise a second array of light sources which are directed radially outward. The second array facilitates the recognition of an entrapment device from an extended distance, as a number of light sources directed toward the player are present on the device.

Light sources referred to in this disclosure may comprise one of light emitting diodes (LEDs), incandescent light bulbs, gas-discharge lamps, arc lamps, lasers, sulfur lamps, or any other electric lights. Light sources may comprise white lights, colored lights, or combinations thereof. Light sources may be configured to pulse, blink, or flash in a manner that players find enjoyable. In some examples, a light device provides illumination that is evenly distributed about the circumference of an entrapment device. During a game of disc golf, it is typical that players will approach the entrapment device from different directions and elevations. In some examples, the light device provides an illumination that appears substantially uniform from all angles. To this end, the number of light sources is chosen that will provide the proper light distribution. Experimental testing has shown that a first array of a light device can include at least three light sources. The first array of some examples comprises at least ten light sources, and in other examples at least twelve light sources. Light sources are spaced apart and oriented about the substantially ring-shaped structure such that, when the device is disposed on a portion of a flying disc entrapment device, the light sources illuminate substantially all of a circumference of an illuminated portion of the device. In some examples, the illuminated portion is the absorption structure or motion arresting structure of the disc golf target, such as chains suspended from a ring cap assembly or an inverted cone mounted to the upright pole. In some examples, the illuminated portion is a segment of the upright pole that is above the top opening basket. The phrase "substantially all of a circumference" is intended to refer to 270 degrees or more of an outer boundary of the illuminated portion.

Other embodiments include devices with any of the features of the devices of FIGS. 1-12, further comprising a sensor configured to automatically provide illumination in low light conditions. This functionality is generally implemented using a light-controlled variable resistor, also referred to as a photocell or photoresistor. Light sources will be powered once the photoresistor has crossed a threshold resistance, the threshold resistance corresponding to a level of environmental darkness considered to be substantially dark. The term "substantially" as applied to dark means a condition of low light which precludes the normal perception of disc golf entrapment device from distances typical of the game.

Generally, light devices are sized and configured to be selectively placed upon and removed from a first portion of an entrapment device in order to illuminate a second portion of the entrapment device. The first portion is typically a ring assembly, or any other structure employed on a flying disc target to suspend a means of arresting an incoming disc, such as a plurality of chains or other web construction. On other styles of target, this first portion may comprise a basket which is used for capturing a falling disc after its forward momentum has been transferred to the motion arresting structure, such as an inverted cone. The second portion of the entrapment device refers to the disc motion arresting structure, as this is the portion of the target that is desired to be struck by a disc. Motion arresting structures can include chains suspended from the ring cap assembly or can also include an inverted cone.

During one example of use of the light device with a disc golf target, the light device is placed on top of a disc golf target. The light device is positioned to permit the maximum number of light sources to shine between spokes on a ring cap assembly. Light device is placed on top of a disc golf basket to illuminate a target area on an upright pole of the disc golf target and illuminate the chains, in order to make the disc golf target more visible during low light conditions.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The invention has been described with reference to various specific and preferred embodiments and techniques. However, it should be understood that many variations and modifications may be made while remaining within the spirit and scope of the invention.

What is claimed is:

1. A light device for use on a flying disc entrapment device comprising:

a substantially ring-shaped structure having a translucent first side and an opaque second side;

a plurality of light sources attached to the substantially ring-shaped structure, the plurality of light sources directed toward the first side;

a battery power source configured to provide power to the light sources;

a switch configured to control the illumination provided by the light sources; and a pump circuit electrically connected to the battery power source and the light sources, the pump circuit configured to supply a pulsed current to the plurality of light sources.

2. The light device of claim 1, the second side comprising a reflective material to direct light to the first side.

3. The light device of claim 1, further comprising a locking loop configured for receiving a locking device.

4. The light device of claim 1, wherein the substantially ring-shaped structure defines a cavity, and wherein the plurality of light sources is housed within the cavity.

5. The light device of claim 4, wherein the cavity is separated from the environment by a water-resistant seal.

6. The light device of claim 5, further comprising:

a tube defining the cavity and having two ends; and a coupler configured to connect the two ends of the tube to form a ring.

7. The light device of claim 6 wherein the coupler is configured to receive the two ends of the tube, wherein the coupler is further configured to enclose the battery power source and pump circuit.

8. The light device of claim 1, wherein the plurality of light sources comprises ten or more light sources.

9. The light device of claim 1, further comprising a light sensor configured to control power to the light sources based on whether the ambient environment is substantially dark.

10. The light device of claim 1, wherein the light device is configured so that the battery power source is accessible and replaceable.

11. A light device for use on a flying disc entrapment device comprising:

a substantially ring-shaped structure defining an opening; and three light sources attached to the substantially ring-shaped structure surrounding the opening, wherein each light source is directed toward a first side of the ring-shaped structure; and a power source configured to provide power to the light sources; and a switch configured to control the illumination provided by the light sources;

wherein the light sources are spaced apart and oriented about the substantially ring-shaped structure in a circular pattern.

12. The light device of claim 11, further comprising a carrying structure to facilitate attaching the light device to another structure, the carrying structure comprising a flexible member loop secured around the substantially ring-shaped structure.

13. The light device of claim 11, wherein the first side defines a plurality of evenly spaced grooves, wherein each groove extends in a radial direction.

14. The light device of claim 11 wherein the substantially ring-shaped structure comprises a plurality of interlocking sections of material, and wherein the light device further comprises a photovoltaic cell attached to an exterior surface of the second side of the light device opposite from the first side, wherein the photovoltaic cell is configured to supply power to the battery power source.

15. The light device of claim 11, further comprising a solar cell configured to supply charge to the battery.

16. The light device of claim 11, wherein the power source is a battery, further comprising:

a pump circuit electrically connected to the power source and the light sources, the pump circuit configured to supply a pulsed current to the light sources.

17. The light device of claim 11, further comprising:

a light sensor configured to selectively provide pulsed current from the pump circuit to the light sources when an ambient environment is substantially dark.

18. The light device of claim 11, wherein the substantially ring-shaped structure is sized and configured to be selectively placed upon and removed from a flying disc entrapment device to illuminate a plurality of chains.

19. A system for illuminating a flying disc entrapment device comprising:

a flying disc entrapment device comprising:

an open top basket mounted on an upright pole; a ring cap assembly mounted on the upright pole above the open top basket; and a plurality of chains suspended from the ring cap assembly; and a light device comprising:

a substantially ring-shaped structure defining an opening;

a first array comprising three light sources attached to the substantially ring-shaped structure surrounding the opening, wherein the light sources are directed toward a first side of the ring-shaped structure;

a battery power source; and a switch configured to control the illumination provided by the first array of light sources;

wherein the substantially ring-shaped structure is sized and configured to be selectively placed upon and removed from the ring cap assembly to illuminate the plurality of chains.

20. The system of claim 19, wherein the substantially ring-shaped structure comprises:

a tube defining a cavity and having two ends; and a coupler connecting the two ends of the tube to form a ring;

wherein the light sources are housed within the cavity.

21. The system of claim 19 wherein the substantially ring-shaped structure comprises a plurality of interlocking sections of material, and wherein the light device further comprises a solar cell attached to an exterior surface of a second side of the light device opposite from the first side, wherein the solar cell is configured to supply power to recharge the battery power source.

* * * * *